US009487379B2

(12) United States Patent
Dong

(10) Patent No.: US 9,487,379 B2
(45) Date of Patent: Nov. 8, 2016

(54) LANDING COVER SYSTEM FOR ESCALATOR FLOOR AND ESCALATOR SYSTEM

(71) Applicant: KONE Corporation, Helsinki (FI)

(72) Inventor: Yajun Dong, Kunshan Jiangsu province (CN)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/935,008

(22) Filed: Nov. 6, 2015

(65) Prior Publication Data

US 2016/0130118 A1 May 12, 2016

(30) Foreign Application Priority Data

Nov. 7, 2014 (CN) ..... 2014 1 0642578

(51) Int. Cl.
*B66B 23/00* (2006.01)
*B66B 21/02* (2006.01)

(52) U.S. Cl.
CPC ..... *B66B 23/00* (2013.01); *B66B 21/02* (2013.01)

(58) Field of Classification Search
CPC ..... B66B 29/06; B66B 23/00; B66B 21/02
See application file for complete search history.

(56) References Cited

U.S. PATENT DOCUMENTS 5,628,391 A * 5/1997 Volkening ..... B66B 23/00 198/325
2010/0129141 A1* 5/2010 Gonzalez Alemany ..... B66B 31/00 403/50

* cited by examiner

*Primary Examiner* — Thomas Randazzo
(74) *Attorney, Agent, or Firm* — Birch, Stewart, Kolasch & Birch, LLP

(57) ABSTRACT

A landing cover system for an escalator floor and an escalator system are disclosed. The landing cover system includes at least two covers configured to form the surface of the escalator floor by matching the two covers together, a frame configured to support the at least two covers and a first water groove disposed at the inner side of the frame and configured to receive the fluid flowing from the at least two covers into the frame. The escalator system includes a first landing cover system disposed at the upper portion of the escalator system, a second landing cover system disposed at the lower portion of the escalator system and an electric driving system disposed between the first landing system and the second landing system to transport objects between the first landing system and the second landing system, wherein the first landing system and the second landing system are the landing systems described previously. The landing cover system for an escalator floor and the escalator system according to the present invention can enhance the waterproof performance of the escalator.

11 Claims, 2 Drawing Sheets

LANDING COVER SYSTEM FOR ESCALATOR FLOOR AND ESCALATOR SYSTEM

CROSS-REFERENCE TO RELATED APPLICATIONS

This application claims priority under 35 U.S.C. §119(a) to Application No. 201410642578.7, filed in China on Nov. 7, 2014, the entire contents of which being incorporated herein by reference.

FIELD OF THE INVENTION

The present invention relates to the electrical field, and particularly to a landing cover system for an escalator floor and an escalator system.

BACKGROUND OF THE INVENTION

In general, there is a landing cover system for an escalator floor disposed in the area before entering the escalator. In the conventional landing cover system for an escalator floor, the landing cover is generally manufactured without any waterproofing, because the electronic components located therebelow, such as the electric motor and control unit for the escalator, have been made with waterproofing according to a corresponding standard. However, such a waterproofing level is generally only effective for a small amount of water, such as the water amount of water needed to clean the landing cover system, and thus the waterproofing level is not enough for a larger amount of water, such as caused by moderate or heavy rain, and the waterproofing level designed for moderate or heavy rain will significantly increase the cost of the electrical motor and control unit for an escalator, which is not beneficial for the manufacture of the escalator.

Currently, a device designed for the above purpose primarily uses an aluminum extrusion profile in the floor plate frame and includes a very shallow trench in the profile to guide the inflow of water from the side. However, the water in the middle of each portion of the floor plate frame is not well collected, and the guided water is not effectively collected and directed to the designated location, and thus rainwater collection does not work well. On the other hand, the amount of water collected in the environment around the escalator does not have a very wide range of adaptation and could only be applied to the case of short-term rainwater and minor water amounts produced during the cleaning procedure. Thus, the rainwater collection under other circumstances would not be achieved substantially.

SUMMARY OF THE INVENTION

The main purpose of the device according to the present invention is to collect the rainwater and dust in the environment around an escalator to protect the mechanical and electrical components at the upper and lower positions of the escalator. Meanwhile, the rainwater could also be collected and guided to a designated position and thus the working condition at the lower position could be further improved.

In view of the prior art and the technical problem thereof identified above, a first aspect of the present invention proposes a landing cover system for an escalator floor, wherein the landing cover system comprises:

at least two covers configured to form a surface of the escalator floor by matching the two covers together;

a frame configured to support the at least two covers; and a first water groove disposed at an inner side of the frame and configured to receive fluid flowing from the at least two covers into the frame.

The landing cover system and escalator system according to the first aspect of the present invention can enhance the waterproof performance of the escalator and thus the electrical components below the landing cover system of the escalator can be better protected against erosion from water and dust to improve the stability of the system.

In one embodiment of the present invention, the landing cover system comprises a second water groove in communication with the first water groove and configured to guide the fluid flowing from a splice between the at least two covers.

According to the present invention, the second water groove is creatively designed below the splice between the at least two covers and thus the fluid flowing through the at least two covers can be guided, even though the seal or waterproof performance at the splice between the at least two covers does not work well. Thus, the fluid will not flow to the electronic components located therebelow to avoid damage to the electronic components.

In one embodiment of the present invention, the second water groove is removably arranged on one of the at least two covers. Based on this configuration, the covers can be uniformly manufactured and thus the design and manufacture cost of the cover for an escalator system can be further reduced.

In one embodiment of the present invention, the landing cover system comprises a guiding pipe, the guiding pipe being disposed at the bottom portion of the first water groove to guide the fluid in the first water groove via the guiding pipe. By using the configuration of such a guiding pipe, the collected fluid can be guided to a proper position for further processing.

In one embodiment of the present invention, the guiding pipe is a plastic hose and/or the diameter of the guiding pipe is at least 22 mm. By using such a plastic hose, the guiding path can be flexibly configured to optimize the fluid guiding.

In one embodiment of the present invention, the at least two covers are rectangular covers. The design of rectangular covers is on one hand beneficial for manufacturing and on the other hand beneficial for assembling and disassembling of the rectangular covers.

In one embodiment of the present invention, the first water groove is removably disposed at the inner side of the frame. By using such a configuration the water groove can be easily disassembled and exchanged when the water groove fails or has other defects, and thus the manufacturing and maintaining cost of the cover system used for an escalator can be further reduced.

In one embodiment of the present invention, the frame is a U-shaped frame.

A second aspect of the present invention proposes an escalator system, wherein the escalator system comprises:

a first landing cover system disposed at an upper portion of the escalator system;

a second landing cover system disposed at a lower portion of the escalator system; and an electric driving system disposed between the first landing system and the second landing system to transport objects between the first landing system and the second landing system, wherein the first landing system and the second landing system are landing systems according to the first aspect of the present invention.

By using the landing cover system according to the first aspect of the present invention, the escalator system according to the present invention can protect the electrical components below the landing cover system of the escalator better against erosion from water and dust, and the electrical components do not need any other waterproofing designs. Thus, the design and manufacturing cost of the escalator system can be significantly reduced. On the other hand, the stability of the whole escalator system is improved, while the cost is reduced, more specifically, because the electrical components below the landing cover system of the escalator can be protected against erosion from water and dust, and thus, the safety of these electrical components during operation is significantly improved. Therefore, the stability of the whole escalator system is improved.

In one embodiment of the present invention, the escalator system further comprises an oil-water separator, and the fluid in the first water groove of the first landing cover system is guided into the oil-water separator via the guiding pipe of the first landing cover system.

In one embodiment of the present invention, the escalator system further comprises an oil-water separator, and the fluid in the first water groove of the first landing cover system is guided into an oil groove in a tilt section of the electric driving system via the guiding pipe of the first landing cover system and is further guided into the oil-water separator and/or the fluid in the first water groove of the second landing cover system is guided into the oil-water separator via the guiding pipe of the second landing cover system.

The device according to the present invention is a technical solution that adds additional water grooves to the conventional design in the prior art. The scheme in the present invention designs a specific water groove to collect water flowing from the splice between two covers to ensure that the collection meets the requirements. Firstly, water grooves are added on two sides and at a rear portion of the floor frame and the water grooves are removably designed and thus it is beneficial for maintaining the system. Therefore, all the rainwater and dust on the two sides and at the rear portion of the frame can be flushed out to the water grooves mounted thereon. There is also the possibility that the water can flow into the lower position through the splice between two covers and thus an additional water groove is added below the splice. Therefore, the water flowing through the splice can also be guided to the main water groove and the water collection performance can be guaranteed. By connecting the main water grooves on the two sides of the frame with a plastic hose with a diameter of at least 22 mm, the rainwater in the main water groove can be guided in time to ensure the efficiency of the usage of the water groove. The landing cover system and escalator system can also be used in an outside environment with a small or moderate amount of rain. The rainwater on the top of the escalator can be guided into an oil groove in the tilt section of the electric driving system and further guided into the oil-water separator and/or the fluid in the water groove on the bottom of the escalator can be guided into the oil-water separator directly.

The landing cover system and escalator system can enhance the waterproofing performance of the escalator and thus the electrical components below the landing cover system of the escalator can be better protected against erosion from water and dust to improve the stability of the system.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF DRAWINGS

Other features, objects and advantages of the invention will become more apparent upon review of the following detailed description of non-limiting embodiments taken with reference to the drawings in which.

Identical or similar devices (modules) or steps will be denoted by identical or similar reference numerals throughout the drawings.

DETAILED DESCRIPTION OF EMBODIMENTS

The below-described particular description of preferred embodiments will be given with reference to the drawings constituting a part of the invention. The drawings illustrate particular exemplary embodiments, in which the present invention can be practiced. The exemplary embodiments are not intended to exhaust all the embodiments of the present invention. As can be appreciated, other embodiments can be possible or structural or logical modifications can be made without departing from the scope of the present invention. Thus the following detailed description is not intended to be limiting, and the scope of the present invention will be defined as in the appended claims.

Figure 1:
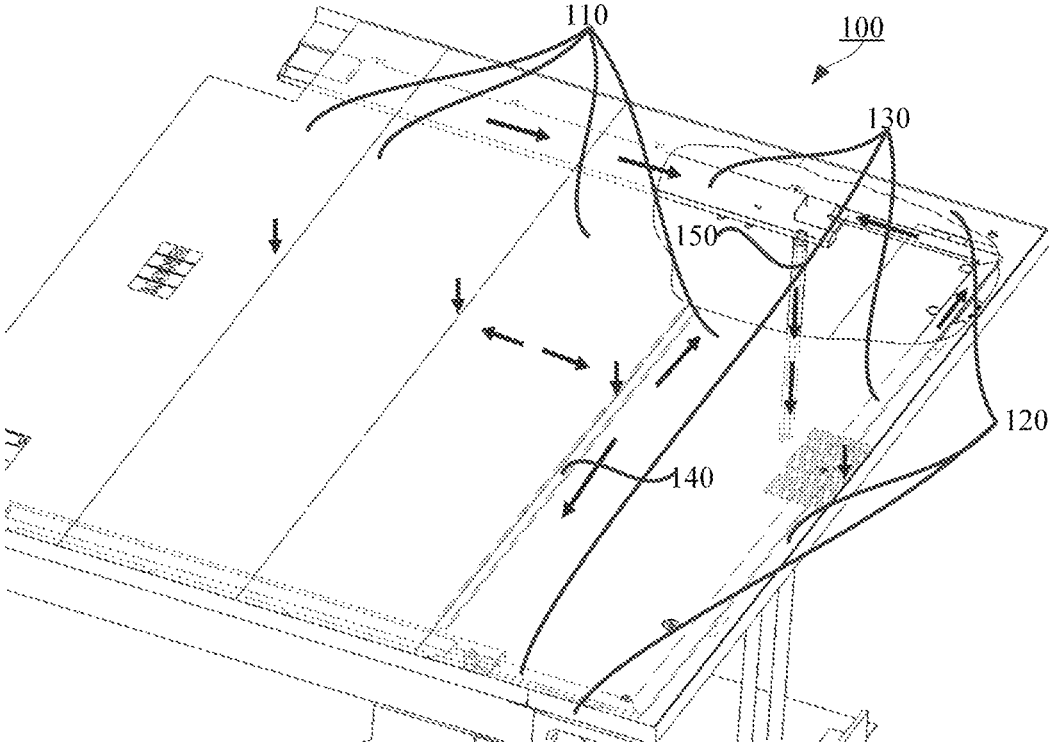
FIG. 1 is a schematic assembling diagram 100 of the landing cover system for an escalator floor according to an embodiment of the present invention.

The specific embodiments of the present invention will be described in conjunction with the accompanying drawings in the following description of the invention. FIG. 1 is a schematic assembling diagram 100 of the landing cover system for an escalator floor according to the present invention. As shown in FIG. 1, the landing cover system for an escalator floor according to the present invention comprises:

at least two covers 110 configured to form a surface of the escalator floor by matching the covers together;

a frame 120 configured to support the at least two covers 110; and a first water groove 130 disposed at the inner side of the frame 120 and configured to receive fluid flowing from the at least two covers 110 into the frame 120.

The landing cover system and escalator system can enhance the waterproofing performance of the escalator and thus the electrical components below the landing cover system of the escalator can be better protected against erosion from water and dust to improve the stability of the system.

In one embodiment of the present invention, the frame 120 is a U-shaped frame.

In one embodiment of the present invention, the landing cover system 100 comprises a second water groove 140 in communication with the first water groove 130 and configured to guide the fluid flowing from a splice between the at least two covers 110. Those skilled in the art should understand that this configuration is only illustrative; this means the second water groove is not required. For example, if the seal at the connection between the at least two covers 110 works well and the fluid will not flow through the splice therebetween, then the second water groove 140 is not necessary.

According to the present invention, a second water groove is creatively designed below the splice between the at least two covers and thus the fluid flowing through the at least two covers can be correspondingly guided even though the seal or waterproofing performance at the splice between the at least two covers does not work well. Thus, the fluid will not flow to the electronic components located therebelow to avoid damage to the electronic components.

In one embodiment of the present invention, the second water groove 140 is removably arranged on one of the at least two covers 110. Based on this configuration, the covers 110 can be uniformly manufactured and thus the design and manufacturing cost of the cover for an escalator system can be further reduced.

In one embodiment of the present invention, the landing cover system 100 further comprises a guiding pipe 150, the guiding pipe 150 being disposed at the bottom portion of the first water groove 130 to guide the fluid in the first water groove 130 via the guiding pipe 150. By using the configuration of such a guiding pipe 150, the collected fluid can be guided to a proper position for further processing.

In one embodiment of the present invention, the guiding pipe 150 is a plastic hose and/or the diameter of the guiding pipe is at least 22 mm. By using such a plastic hose, the guiding path can be flexibly configured to optimize the guiding of the fluid.

In one embodiment of the present invention, the at least two covers 110 are rectangular covers. The design of rectangular covers is on one hand beneficial for manufacturing and on the other hand beneficial for assembling and disassembling of the rectangular covers.

In one embodiment of the present invention, the first water groove 130 is removably disposed at the inner side of the frame 120. By using such a configuration, the water groove 130 can be easily disassembled and exchanged when the water groove fails or has other defects, and thus the manufacturing and maintaining cost of the cover system used for an escalator can be further reduced.

Figure 2:
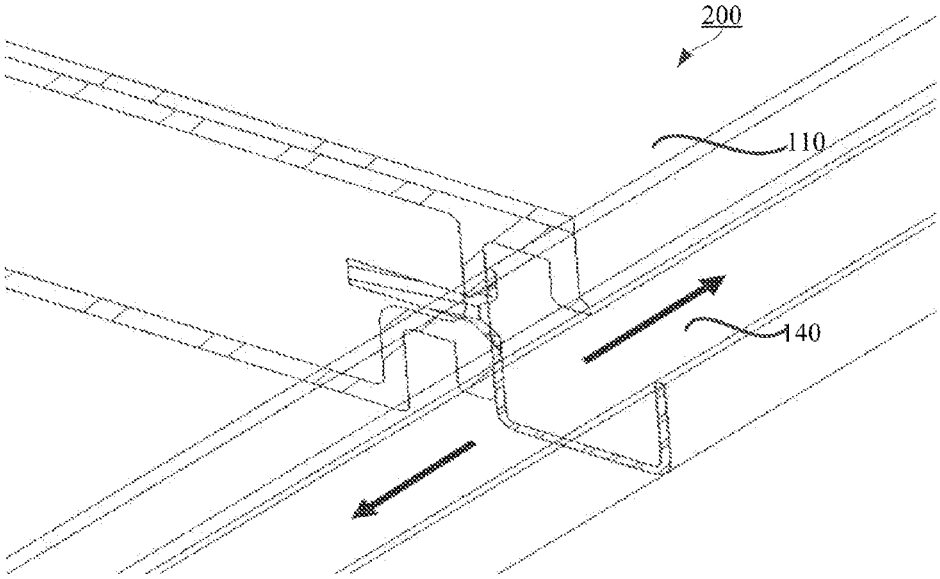
FIG. 2 is a schematic structural diagram 200 at the cover connection of the landing cover system for an escalator floor according to one embodiment of the present invention.
Figure 3:
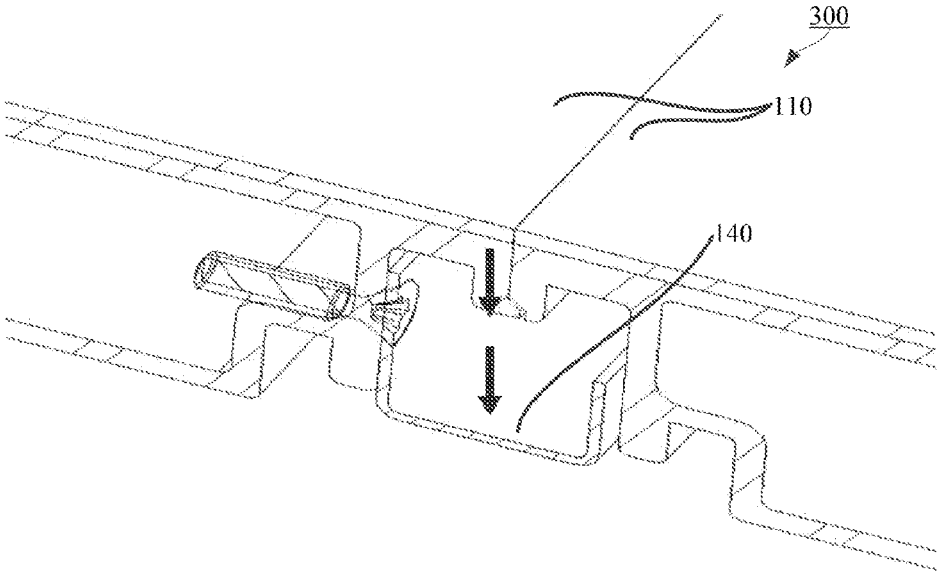
FIG. 3 is a schematic assembling diagram 300 at the cover connection of the landing cover system for an escalator floor according to one embodiment of the present invention.

Below, the assembling of the at least two covers will be described in conjunction with FIGS. 2 and 3. FIG. 2 is a schematic structural diagram 200 at the cover connection of the landing cover system for an escalator floor according to one embodiment of the present invention. FIG. 3 is a schematic assembling diagram 300 at the cover connection of the landing cover system for an escalator floor according to one embodiment of the present invention.

As shown in FIG. 2, the second water groove 140 is removably arranged on one of the at least two covers 110. Based on this configuration, the covers 110 can be uniformly manufactured and thus the design and manufacturing cost of the cover for an escalator system can be further reduced. FIG. 3 is an assembling diagram of the at least two covers as illustrated in FIG. 2. As shown in FIG. 3, at the connection of the two covers 110, because one of the covers 110 has a second water groove 140 and the other of the covers 110 does not have a second water groove 140, such a configuration will be beneficial for assembling. The second water groove can guide the fluid flowing through the splice between the two covers after the two covers are assembled.

Following the introduction of the specific structure of FIGS. 2 and 3, a specific embodiment during usage over time will now be described with regard to FIG. 1. If there is a large amount of water on top of the landing cover system, e.g., in the event of heavy rain or due to negligence of staff and leading to a large amount of water poured on top of the landing cover system, then the water will flow into the splice between the covers 110 as shown by the arrow in FIG. 1 and then the water flows into the first water groove 130 via a second water groove 140; another portion of water flows directly into the side of the landing cover 110 and then flows into the first water groove which is slightly lower than the frame 120; finally, the two parts of water are collected in the first water groove 130 and then guided to a corresponding position for further processing via a guiding pipe 150.

Furthermore, a second aspect of the present invention proposes an escalator system, wherein the escalator system comprises:

a first landing cover system disposed at an upper portion of the escalator system;

a second landing cover system disposed at a lower portion of the escalator system; and an electric driving system disposed between the first landing system and the second landing system to transport objects between the first landing system and the second landing system, wherein the first landing system and the second landing system are landing systems according to the first aspect of the present invention.

By using the landing cover system according to the first aspect of the present invention, the escalator system according to the present invention can better protect the electrical components below the landing cover system of the escalator against erosion from water and dust and the electrical components do not need any waterproofing design. Thus, the design and manufacturing cost of the escalator system can be significantly reduced. On the other hand, the stability of the whole escalator system can be improved while the cost is reduced, more specifically, because the electrical components below the landing cover system of the escalator can be protected against erosion from water and dust and thus the safety of these electrical components during operation can be significantly improved. Therefore, the stability of the whole escalator system can be improved.

In one embodiment of the present invention, the escalator system further comprises an oil-water separator, and the fluid in the first water groove of the first landing cover system is guided into the oil-water separator via the guiding pipe of the first landing cover system.

In one embodiment of the present invention, the escalator system further comprises an oil-water separator, and the fluid in the first water groove of the first landing cover system is guided into an oil groove in the tilt section of the electric driving system via the guiding pipe of the first landing cover system and is further guided into the oil-water separator and/or the fluid in the first water groove of the second landing cover system is guided into the oil-water separator via the guiding pipe of the second landing cover system.

The device according to the present invention is a technical solution that adds additional water grooves to the conventional design in the prior art. The scheme in the present invention designs a specific water groove to collect the water flowing from the splice between two covers to ensure that the collection effectively meets the requirements. Firstly, water grooves are added on the two sides and on the rear portion of the floor frame, and the water grooves are removably designed and thus it is beneficial for maintaining the escalator system. Therefore, all the rainwater and dust on the two sides and on the rear portion of the frame can be flushed to the water grooves mounted thereon. There is also the possibility that the water can flow into the lower position through the splice between the two covers and thus an additional water groove is added below the splice. Therefore the water flowing through the splice can also be guided to the main water groove and the water collection performance can be guaranteed. By connecting the main water grooves on the two sides of the frame with a plastic hose with a diameter of at least 22 mm, the rainwater in the main water groove can be guided in time to ensure the efficiency of the water groove. The landing cover system and escalator system can also be used in an outside environment with a small or moderate amount of rain. The rainwater on the top of the escalator can be guided into an oil groove in the tilt section of the electric driving system and further guided into the oil-water separator and/or the fluid in the water groove on the bottom of the escalator can guided into the oil-water separator directly.

The landing cover system and escalator system can enhance the waterproofing performance of the escalator and thus the electrical components below the landing cover system of the escalator can be better protected against erosion from water and dust to improve the stability of the system.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A landing cover system for an escalator floor, comprising:

at least two covers configured to form a surface of the escalator floor by matching the at least two covers together;

a frame configured to support the at least two covers; and a first water groove disposed at an inner side of the frame and configured to receive fluid flowing from the at least two covers into the frame.

2. The landing cover system according to claim 1, further comprising a second water groove in communication with the first water groove and configured to guide the fluid flowing from a splice between the at least two covers.

3. The landing cover system according to claim 2, wherein the second water groove is removably arranged on one of the at least two covers.

4. The landing cover system according to claim 1, further comprising a guiding pipe, the guiding pipe being disposed at a bottom portion of the first water groove to guide the fluid in the first water groove via the guiding pipe.

5. The landing cover system according to claim 4, wherein the guiding pipe is a plastic hose and/or the diameter of the guiding pipe is at least 22 mm.

6. The landing cover system according to claim 1, wherein the at least two covers are rectangular covers.

7. The landing cover system according to claim 1, wherein the first water groove is removably disposed at the inner side of the frame.

8. The landing cover system according to claim 1, wherein the frame is a U-shaped frame.

9. An escalator system, comprising:

a first landing cover system disposed at an upper portion of the escalator system;

a second landing cover system disposed at a lower portion of the escalator system; and an electric driving system disposed between the first landing system and the second landing system to transport objects between the first landing system and the second landing system, wherein the first landing system and the second landing system are landing systems according to claim 1.

10. The escalator system according to claim 9, further comprising an oil-water separator, and the fluid in the first water groove of the first landing cover system is guided into the oil-water separator via the guiding pipe of the first landing cover system.

11. The escalator system according to claim 9, further comprising an oil-water separator, and the fluid in the first water groove of the first landing cover system is guided into an oil groove in a tilt section of the electric driving system via the guiding pipe of the first landing cover system and further guided into the oil-water separator and/or the fluid in the first water groove of the second landing cover system is guided into the oil-water separator via the guiding pipe of the second landing cover system.

* * * * *